US011364475B2

(12) United States Patent
Shor et al.

(10) Patent No.: US 11,364,475 B2
(45) **Date of Patent: *Jun. 21, 2022**

(54) METHODS OF PREPARING AND USING AN ASEPTIC MIXING SYSTEM

(71) Applicant: SANI-TECH WEST, INC., Camarillo, CA (US)

(72) Inventors: Richard J. Shor, Moorpark, CA (US); Chris A. Ballew, Thousand Oaks, CA (US)

(73) Assignee: SANI-TECH WEST, INC., Camarillo, CA (US)

( * ) Notice: Subject to any disclaimer, the term of this patent is extended or adjusted under 35 U.S.C. 154(b) by 705 days.

This patent is subject to a terminal disclaimer.

(21) Appl. No.: 16/296,006

(22) Filed: Mar. 7, 2019

(65) Prior Publication Data

US 2019/0232242 A1 Aug. 1, 2019

Related U.S. Application Data

(63) Continuation of application No. 14/660,814, filed on Mar. 17, 2015, now Pat. No. 10,265,667.
(Continued)

(51) Int. Cl.
*B01F 33/453* (2022.01)
*B01F 27/053* (2022.01)
(Continued)

(52) U.S. Cl.
CPC ..... *B01F 33/453* (2022.01); *B01F 27/053* (2022.01); *B01F 27/0541* (2022.01); *B01F 33/4534* (2022.01); *B01F 33/86* (2022.01)

(58) Field of Classification Search
CPC ..... B01F 7/00033; B01F 7/00058; B01F 13/0827; B01F 13/0863; B01F 15/00006
(Continued)

(56) References Cited

U.S. PATENT DOCUMENTS 385,151 A 6/1888 Thompson
955,978 A 4/1910 Mitchell
(Continued)

FOREIGN PATENT DOCUMENTS

CN 202751989 U 2/2013
CN 103071418 A 5/2013
(Continued)

OTHER PUBLICATIONS

Carl Roth; Laboratory Glass, Vessels, Consumables/Stirrer Reactor SETS/1 GL 45 Stirrer Reactors; Duran Group Material Duran; Mar. 13, 2014, 2 Pages; www.carlroth.com.
(Continued)

*Primary Examiner* — Marc C Howell
(74) *Attorney, Agent, or Firm* — SoCal IP Law Group LLP; Guy Cumberbatch; Steven Sereboff

(57) ABSTRACT

A mixing system typically for use in a container for mixing its contents, the mixing system including a cap unit, an extension unit and a magnetic mixing unit that is attached to the cap unit by the extension unit. The magnetic mixing unit can be folded to permit insertion and/or removal of the system via a mouth of the container. The extension unit and magnetic mixing unit connect via a hinge formed by upper and lower hinge portions that meet at a pivot point. The hinge portions extend from the pivot point along a first axis. The magnetic mixing unit includes a first magnetic elongate member that extends from the lower hinge portion along a second axis that is substantially perpendicular to the first axis, and a second magnetic elongate member that extends from the lower hinge portion along the second axis in the opposite direction relative to the first elongate member. The magnetic member(s) may be provided by a plastic coated magnetic stir bar.

20 Claims, 22 Drawing Sheets

Related U.S. Application Data

(60) Provisional application No. 61/954,465, filed on Mar. 17, 2014.

(51) Int. Cl.
*B01F 27/054* (2022.01)
*B01F 33/00* (2022.01)

(58) Field of Classification Search
USPC ..... 366/247
See application file for complete search history.

(56) References Cited

U.S. PATENT DOCUMENTS

| | | | | |
|---|---|---|---|---|
| 1,242,493 | A | 10/1917 | Stringham | |
| 2,350,534 | A | 6/1944 | Rosinger | |
| 2,844,363 | A | 7/1958 | Clark | |
| 1,436,172 | A | 11/1958 | Eddy et al. | |
| 2,859,020 | A * | 11/1958 | Eddy | A47J 43/0465 366/274 |
| 2,896,926 | A * | 7/1959 | Chapman | B01F 7/00058 416/66 |
| D200,494 | S | 3/1965 | Bezark, Jr. | |
| 3,209,387 | A | 10/1965 | Lukesch | |
| 3,243,165 | A | 3/1966 | De Woody | |
| 3,306,829 | A | 2/1967 | Patterson et al. | |
| 3,572,651 | A | 3/1971 | Harker | |
| 3,622,129 | A | 11/1971 | Mazowski | |
| 4,162,855 | A | 7/1979 | Bender | |
| 4,204,774 | A | 5/1980 | de Bruyne | |
| 4,355,906 | A | 10/1982 | Ono | |
| 4,382,685 | A | 5/1983 | Pearson | |
| 4,512,666 | A | 4/1985 | O'Connell | |
| 4,882,062 | A | 11/1989 | Moeller et al. | |
| 5,183,336 | A | 2/1993 | Poltorak | |
| 5,240,322 | A | 8/1993 | Haber et al. | |
| 5,267,791 | A | 12/1993 | Christian et al. | |
| 5,529,391 | A | 6/1996 | Kindman et al. | |
| 5,586,823 | A | 12/1996 | Carr | |
| 8,057,092 | B2 | 11/2011 | Ryan et al. | |
| 8,337,074 | B2 | 12/2012 | Wild et al. | |
| 2004/0047232 | A1 * | 3/2004 | Terentiev | B01F 7/16 366/273 |
| 2005/0088907 | A1 | 4/2005 | Vanek | |
| 2007/0125894 | A1 | 6/2007 | Koop | |
| 2008/0013400 | A1 | 1/2008 | Andrews et al. | |
| 2008/0269668 | A1 | 10/2008 | Keenan | |
| 2009/0219780 | A1 | 9/2009 | Castillo | |
| 2010/0100099 | A1 | 4/2010 | Reilly | |
| 2010/0290308 | A1 | 11/2010 | Terentiev | |
| 2011/0038222 | A1 | 2/2011 | Ludwig et al. | |

FOREIGN PATENT DOCUMENTS

| | | | |
|---|---|---|---|
| CN | 203030232 | U | 7/2013 |
| CN | 203123598 | U | 8/2013 |
| CN | 203124004 | U | 8/2013 |
| CN | 203183963 | U | 9/2013 |
| CN | 203196580 | U | 9/2013 |
| DE | 102006022651 | B3 | 10/2007 |
| EP | 0127971 | B1 | 10/1990 |
| EP | 2133139 | B1 | 4/2012 |
| WO | 03049845 | A1 | 6/2003 |
| WO | 2014003640 | A1 | 1/2014 |

OTHER PUBLICATIONS

Wenk Lab Tec; Folding Magnetic Stirrer for GL45 Stirred Reactor, Incl. S; Mar. 12, 2014, 2 Pages; www.wen-labtec.com.
International Search Report dated Jun. 24, 2015 for International application No. PCT/US2015/021112.
Extended European Search Report dated Mar. 19, 2018 for European application No. 15764790.0.

* cited by examiner (c) 2019 Sani-Tech West, Inc.

Z
X (c) 2019 Sani-Tech West, Inc.

(c) 2019 Sani-Tech West, Inc.

(c) 2019 Sani-Tech West, Inc.

(c) 2019 Sani-Tech West, Inc.

Z
X

CONTAINER AXIS

SIDE

TOP

BOTTOM (c) 2019 Sani-Tech West, Inc.

(c) 2019 Sani-Tech West, Inc.

FIG. 10A
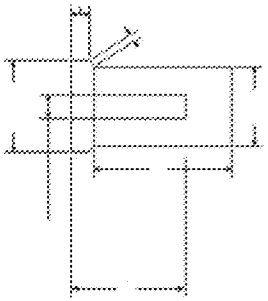
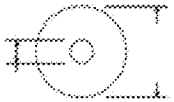
FIG. 10B
(c) 2019 Sani-Tech West, Inc.

(c) 2019 Sani-Tech West, Inc.

(c) 2019 Sani-Tech West, Inc.

FIG.13A
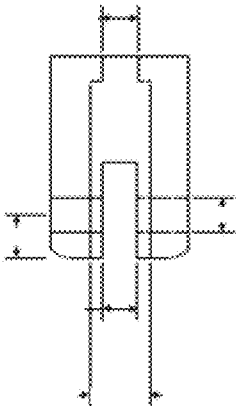
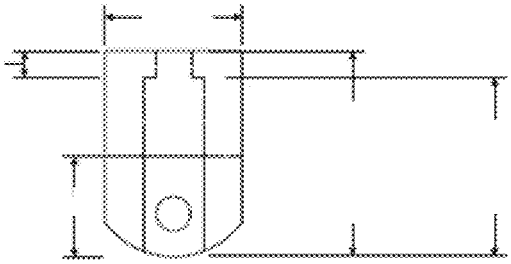
FIG. 13B
(c) 2019 Sani-Tech West, Inc.

(c) 2019 Sani-Tech West, Inc.

(c) 2019 Sani-Tech West, Inc.

(c) 2019 Sani-Tech West, Inc.

(c) 2019 Sani-Tech West, Inc.

METHODS OF PREPARING AND USING AN ASEPTIC MIXING SYSTEM

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This application is a continuation of U.S. patent application Ser. No. 14/660,814, filed Mar. 17, 2015, which claims priority from U.S. Provisional Patent Application Ser. No. 61/954,465, filed Mar. 17, 2014, the disclosures of which are hereby incorporated by reference in its entirety.

BACKGROUND

Field

The present invention relates to a mixing system, and in particular to a magnetic mixing system and method.

Description of the Related Art

In the preparation of liquid components for biotech and pharmaceutical processing, it is important to perform mixing within a closed environment. The process of manufacturing a biological is very delicate and can fail due to a breach within a closed system because of bacterial or viral ingress. In many instances, certain chemicals must be blended into liquid to form a component of the process or must be continuously stirred in order to inhibit separation during the process. The process is controlled at every step to assure a constant temperature, balanced PH, and foreign substances stay out of the process. For example, it would be undesirable to have heat from a motor disrupting the process. It would also be undesirable to have a large opening in the system, and it would certainly be undesirable to stick one's hand, fingers or other foreign objects into or proximate the process or system. Further, undue shear or vibration will adversely affect the integrity of the system.

Some applications of a magnetic stirrer may be in a perfusion vessel or an aseptic separator device. Other uses may exist.

Long ago, i.e., at least as early as 1917, a magnetic stirrer was proposed by Stringham in U.S. Pat. No. 1,242,493, and later in 1942 improved by Rosinger in U.S. Pat. No. 2,350,534. The stifling element consisted of a rod-shaped magnet inside and a neutral shell or covering around it. The magnet that caused the stirring element to rotate was U-shaped and had the poles pointing upward, and was rotatably mounted around a vertical axis, coinciding with a central point on the stirrer. The stirrer rod was simply dropped in the container, and allowed to sit on the bottom of the container.

However, it is much better to suspend the stirrer so that it does not touch the walls or bottom of the container. Touching the bottom or walls can subject the process to a grinding action, which is undesirable and can also serve to produce particulates. Similarly, creation of shear can be problematic for the cells within the process as well. Suspension also eliminates the need for lubrication, which can contaminate the culture. Accordingly, in U.S. Pat. No. 3,572,651 to Harker, the stir bar is suspended.

The controls for the stirrer and the driving force (a magnetic field) may be outside the container in which the cell culture or process is located. Since the driving force is magnetic, no physical connection of the stir bar and the power source are required. Therefore, the container may be properly sealed and free from contaminants to maintain an aseptic environment.

In some conventional systems, a rod-shaped internal magnet is placed within a container holding a fluid to be mixed. The rod-shaped magnet may be free to roam across the bottom of the container, and may be coated with PTFE. The rod-shaped internal magnet may be engaged by an external magnet located below the container and driven to rotate around an axis perpendicular to a longitudinal axis.

The conventional system may allow friction to occur between the internal magnet and an interior surface of the container when the internal magnet rests on an interior surface of the container and is driven to rotate by the external magnet. As a result, debris from the internal magnet may be released such as during irradiation of the mixer for decontamination. For example, the PTFE may begin to break down during irradiation, allowing the coating to crack and shed particles. In addition, the breakdown of the PTFE coating may allow the internal magnet to rust, which may result in additional particle shedding from both the rusting magnet.

In addition, getting the stirring device into the container without damaging the device or container and without contaminating the system can be a challenge. Because the stir bar extends horizontally (normal to the rod holding it), it can be difficult to get a large enough bar to effectively cause mixing inside the container.

The present mixing system may be useful in many ways, such as in aseptic mixing applications for cell culturing or other applications.

The conventional system may have other drawbacks as well.

SUMMARY OF THE INVENTION

Embodiments of the system may permit an oversized mixer to be installed in a container that otherwise would not fit through the neck opening (mouth) of a container, i.e., where the length of the stir bar is greater than the diameter of the mouth of the container. By being suspended from above, the mixing system prevents contact between the mixing system and the interior surface of the container during operation. In various embodiments, the system includes components so that the mixing blade is in an insertion position (substantially normal to its operative position) to minimize the footprint of the apparatus and permit insertion thereof into the container, even if the container has a narrow mouth. The components including the mixing blade may then be dropped into place into its operative, mixing position substantially normal to the insertion position, preferably by gravity. Accordingly, the mixing blade will then be free to rotate around a vertical axis when being driven by an external magnetic force.

One or more components of the system, such as the exterior of the stir bar, may be made from Polyvinylidene fluoride (PVDF). The specific gravity of the stir bar is most preferably 1.78 or about 1.78, or at least preferably between (or from) 1.6 and (or to) 2.0, or about 1.6 to about 2.0. Accordingly, the stir bar will sink in water. Other potential materials may include gamma radiation stable Polycarbonate (PC), Polypropylene (PP), and LDPE Low density Polyethylene. Each of these materials may resist gamma radiation, which may allow the system to be irradiated without substantial degradation of structural integrity. The system may therefore provide better mixing with a reduced likelihood of shedding particles that are mixed into the system.

In some preferred embodiments, the mixing system includes neodymium magnets, which may have a nickel coating. These magnets may have stronger magnetic fields which may allow greater separation between an interior magnet and an external driving magnet, which may result in different mixing effects. In addition or alternatively, the neodymium magnet may have advantages with respect to faster mixing and/or faster response times to changes in speed and/or direction of the external magnet.

Use of a nickel coating may provide advantages with respect to resistance to rust, impact, or cutting in the event that the external coating (e.g., PVDF, PC, PP, LDPE) is damaged or partially removed.

DESCRIPTION OF THE DRAWINGS

FIGS. 8A, 8B, 8C, 9A, 9B, 10A, 10B, 11, 12, 13A, 13B, 14A, 14B, 15A, 15B, 15C, 16A, 16B, 17A and 17B illustrate various optional components of the mixing system, according to an embodiment;

DETAILED DESCRIPTION

Description in Connection with Figures

Figure 1A:
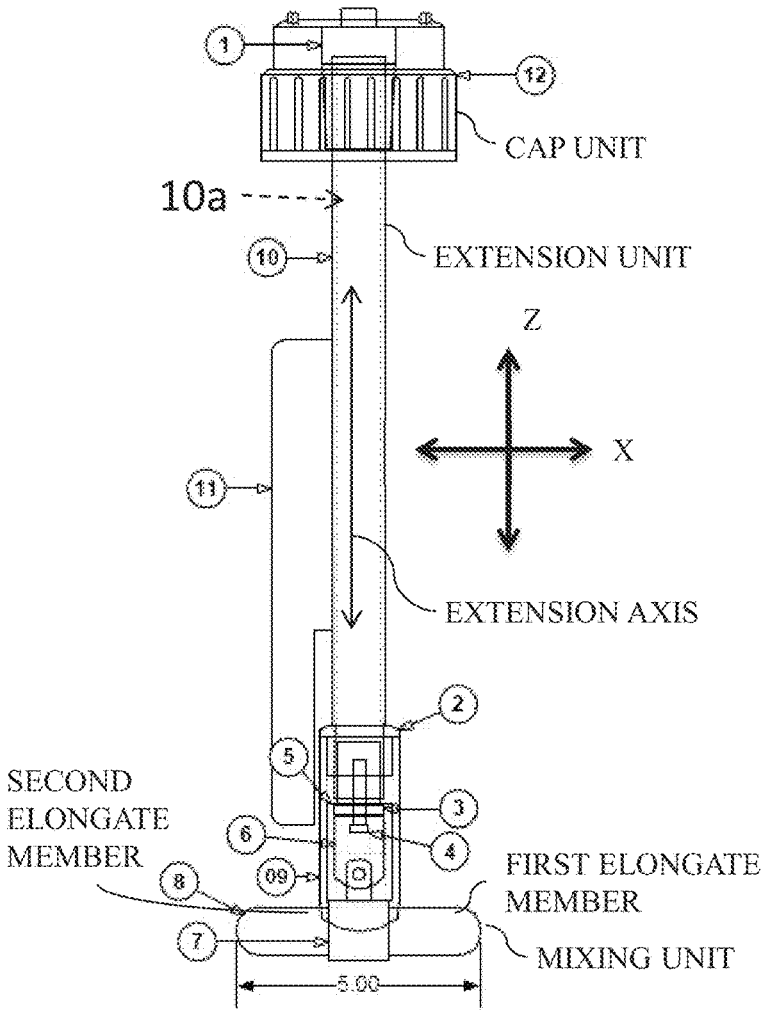
FIGS. 1A and 1B are front and side views of a mixing system, according to an embodiment.
Figure 1B:
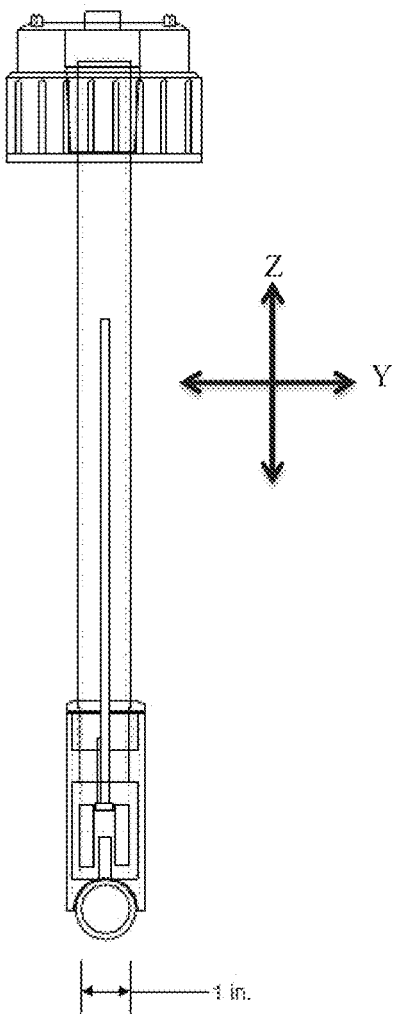

FIGS. 1A and 1B

As shown in FIGS. 1A and 1B, the mixing system may include a top member such as a cap unit, an extension unit, and a mixing unit.

The cap unit may include a cap 12 and a cap connector 1 (e.g., a stabilization connector).

The extension unit may include an extension shaft 10 (e.g., a tube), a lock sleeve cap 2, an upper bearing 3, a bearing pin 4, a joint lock 5, a lock sleeve 9, and a baffle 11. The extension unit may attach the mixing unit to a cap unit of the system. In various embodiments, the extension unit has an extension axis that extends between the cap unit and the mix unit parallel to the Z-axis.

A challenge with a movable mixing blade on a pivot is that the blade will tend to wobble. This wobbling will cause too much turbulence during mixing and the magnetic field will decouple causing damage to the process. Therefore, in a most preferred embodiment, there is a stiffener or reinforcing rod, e.g., of aluminum encapsulated within the extension shaft extending the majority of the length of the shaft (see the dashed lines 10*a* inside extension shaft 10 of FIG. 1A). The aluminum is then surrounded by an inert plastic of a type as noted above for the stir bar.

In some embodiments, a lock sleeve may be moved downward to hold the mixing unit at a mixing position to minimize wobbling.

In various embodiments, one or more baffles 11 may be used to alter fluid flow within the container to cause turbulent mixing and to disrupt laminar rotating fluid flow within the container. A baffle 11 may be attached to an extension shaft 10 of the extension unit at one or more sides. One or more baffles 11 may be attached to the sides of the lock sleeve 9.

The mixing unit may include a hinge formed by an upper hinge 6 portion, a lower hinge portion 7, a pivot (e.g., an axle that connects the upper hinge portion 6 and the lower hinge portion 7 that extends along the Y-axis), and a pair of oppositely extending elongate members (e.g., a first elongate member and a second elongate member forming a stir bar 12) that extend from and are fixed to the lower hinge section 7. The mixing unit may include a first mix section that is comprised of the upper hinge portion 6, and a second mix section that is comprised of the lower hinge portion 7, the first elongate member, and the second elongate member.

In some embodiments, the lower hinge portion 7 may hang downward (e.g., away from the cap unit along the Z-axis) at rest such that the oppositely extending first and second elongate members extend horizontally (e.g., when the system is installed in an upright container, along the Y-axis).

In some embodiments, end pieces of the first and second elongate members may be adapted to have angled plates or fins that extend from the ends of the first and second elongate members in the XY plane. The plates or fins may have rectangular, trapezoidal, or other cross sections. (See FIGS. 18 and 19). These plates or fins may drive upward or downward fluid movement at the outer edges of the container, which may help create a toroidal circulation within the container such that fluid moves upwards or downwards at the outer circumference of the container, and moves in the opposite direction in the center of the container. The plates or fins may generate differently shaped currents than other shapes such as rounded edges, and the fins or plates may alter or affect vortex formation, shedding, and/or movement from the sides of the first and second elongate members as they rotate. The systems for affecting fluid flow described herein may help improve mixing while preventing damage to delicate structures that may be contained in a solution, such as cell walls.

Exemplary Operation

Operation in FIGS. 2A-2G, 3-6, and FIGS. 7A-7G

FIGS. 2A to 2G illustrate the system at a variety of positions, respectively. FIGS. 3, 4, 5, and 6 illustrate enlarged views of four of the positions. FIGS. 7A to 7G illustrate installation of the system in a container through seven sequential positions or steps, respectively. The operations shown in FIGS. 2A to 2G may be performed between the positions shown in FIGS. 7C and 7E, i.e., in preparation for and during insertion of the mixing system into the container shown in FIG. 7D.

Figures 7A, 7B, 7C, 7D, 7E, 7F, 7G:
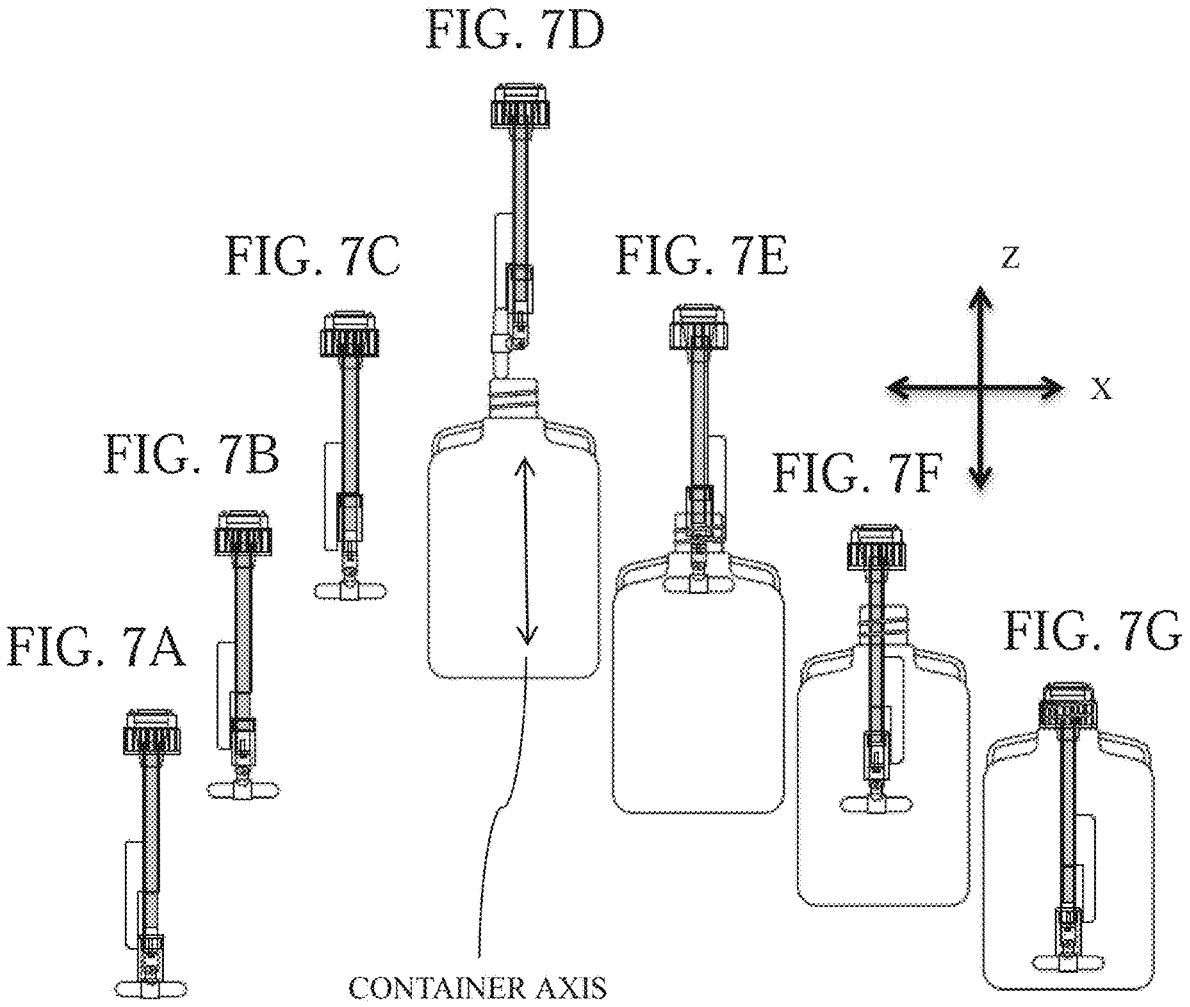
FIGS. 7A to 7G illustrate operation and installation of the mixing system in a container, according to an embodiment.

Before folding the mixing unit, the lock sleeve 9 may need to be moved toward the cap unit along the extension axis, as shown in the progression between FIGS. 7A and 7C.

Figures 2A, 2B, 2C, 2D, 2E, 2F, 2G:
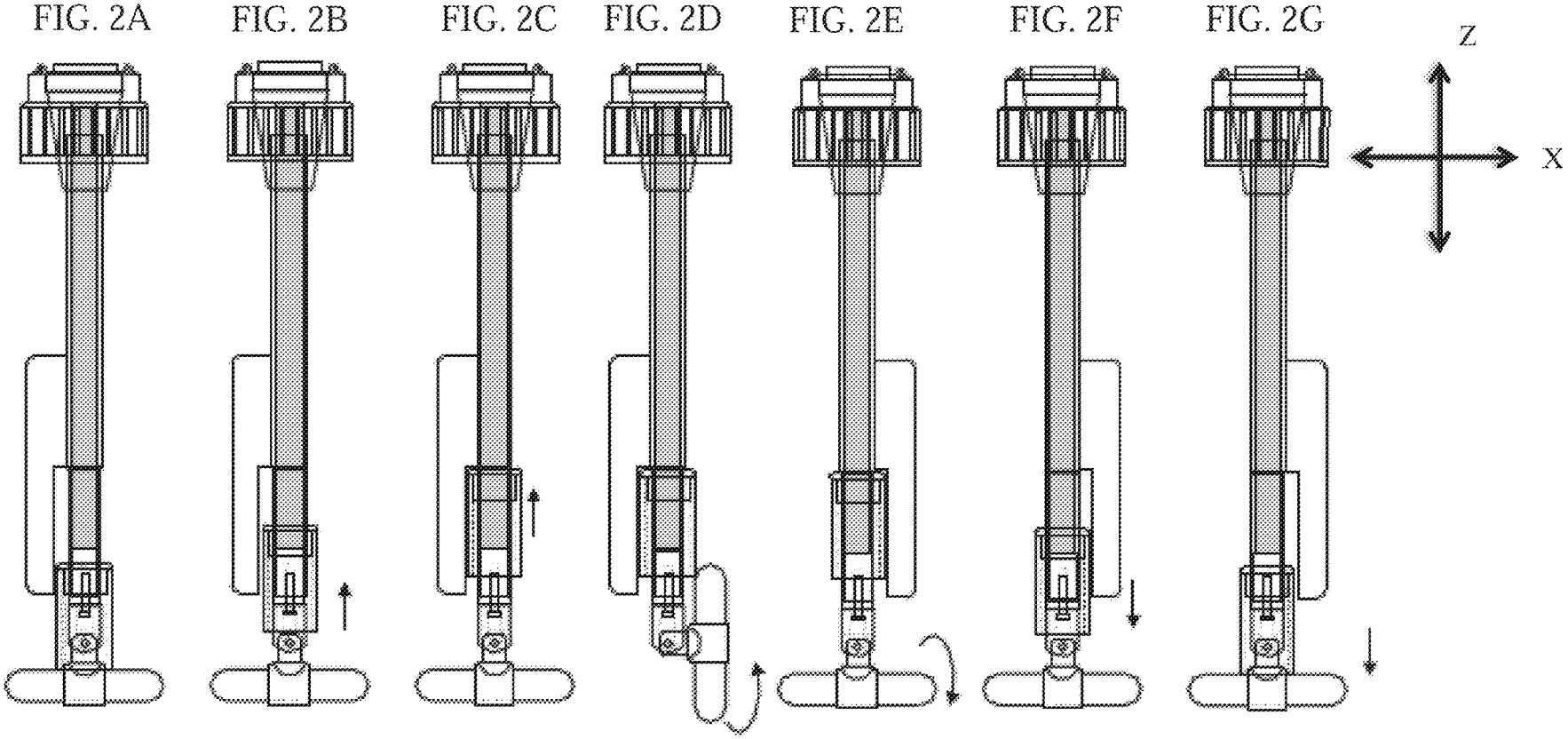
FIGS. 2A to 2G and FIGS. 3 to 6 illustrate operation of the mixing system, according to an embodiment.

For insertion into the container, the mixing unit may be rotated at the pivot such that the lower hinge portion 7 extends laterally (e.g., along the X-axis) away from the extension axis of the extension unit, and the elongate members extend parallel to the extension axis (e.g., parallel to the Z-axis), as shown in FIG. 2D. A first elongate member of the stir bar (e.g., one side of the stir bar, as labeled in FIG. 1A) may thus be positioned to extend upward toward the cap along the Z-axis, while the oppositely oriented second elongate member (e.g., the other side of the stir bar) is positioned to extend downward along the Z-axis toward the bottom of the container. In this position, the first and second elongate members, which are longer in combined length than the interior width of the bottle opening, may be positioned for insertion or extraction through the mouth of the container opening. In embodiments having a baffle 11 attached to the extension shaft 10, the mixing unit may be bent at the pivot towards the same side of the system where the baffle 11 is disposed, which may reduce a lateral width of the system for insertion into a container. (See FIG. 7D).

In various embodiments, the mixing unit can be held upward at a folded position (e.g., substantially parallel to the extension axis) with one of the user's hands while the other hand holds the cap and inserts the system into the container. (See FIG. 7D). Alternatively, the user may insert the system at an angle and rotate the entire system during insertion to the vertical position, and/or the pivot may be designed with a little bit of friction such as a detent at the pivot point at the vertical or storage position (FIG. 7D).

The mixing unit can then be inserted and once inside the mouth released. (See FIG. 7E). When the system is installed in an upright container, the mixing unit may fall into place from its higher potential energy storage position to its lower potential energy mixing position. The fall may take place due to gravity and/or due to a slight jiggling of the system to cause the stir bar to rock out of the vertical position and thus fall to its horizontal position.

The system may then be further lowered into the container until the cap unit can engage the container opening. (See FIGS. 7E to 7G). The interior surface of the cap 12 of the cap unit may be formed with threads that engage with corresponding external threads of the container opening.

Details of FIGS. 3 to 6

Figure 3:
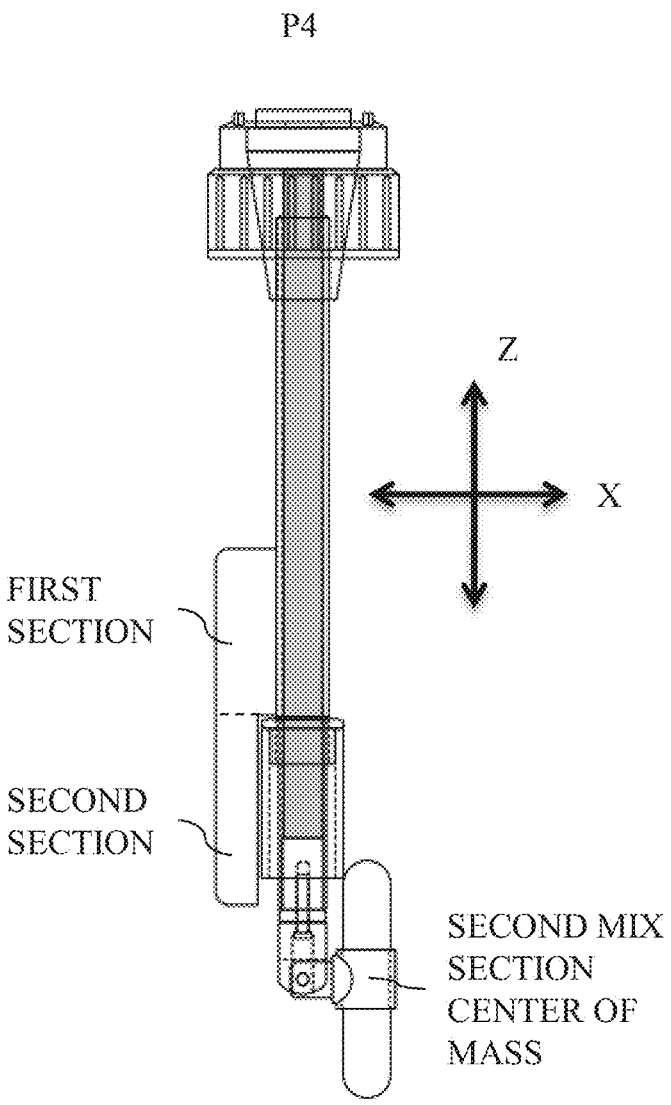

As shown in FIG. 3, the baffle 11 may be parallel to the XZ-plane. The baffle 11 may have a first section that extends away from the extension shaft 10 along the X-axis. The baffle 11 may further include a second section that is thinner in width than the first section along the X-axis direction. The top of the second section (e.g., closest to the cap unit) may be attached to the bottom of the first section, and may extend downward away from the cap unit along the Z-axis.

The bottom edge of the first section and the innermost edge of the second section in the XZ-plane may be configured to form a receiving section or recess that is configured to receive the lock sleeve 9 when the lock sleeve 9 has been moved along the Z-axis towards the cap unit and away from the pivot. In some embodiments, the second section extends along the Z-axis to a position that is higher than the highest part of the first (or second) elongate member that extends towards the cap unit while at a folded position. (See FIG. 7D). This permits folding of the mixing unit towards the baffle 11, which reduces a lateral width (e.g., along the X-axis) of the system when in the folded position.

At the position shown in FIG. 3, the center of mass of the second mix section may be disposed approximately at the same height along the Z-axis as the pivot, and laterally disposed away from the central axis of the pivot along the X-axis. When the system is placed in a container that contains fluid, the second mix section may be pulled downward by gravity, the force of which may be resisted by friction and by buoyancy. The specific gravity of the second mix section may be selected to be high enough to overcome buoyancy as well as friction between the upper hinge portion 6 and the lower hinge portion 7 and the pivot. Thus, when released, the second mix section may fall to the position shown in FIG. 4.

FIG. 4

Figure 4:
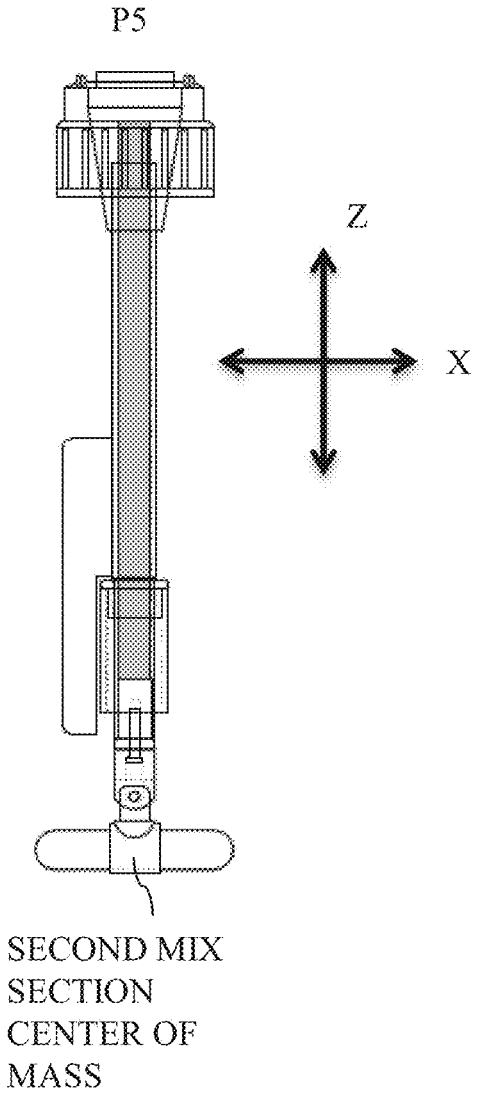

As shown in FIG. 4, the center of mass of the second mix section may be in line with the pivot (e.g., at the same X-axis position), and at a lower position along the Z-axis than the position shown in FIG. 3

FIGS. 5-6

Figure 5:
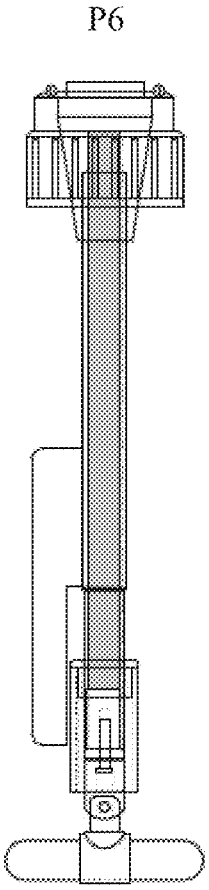
Figure 6:
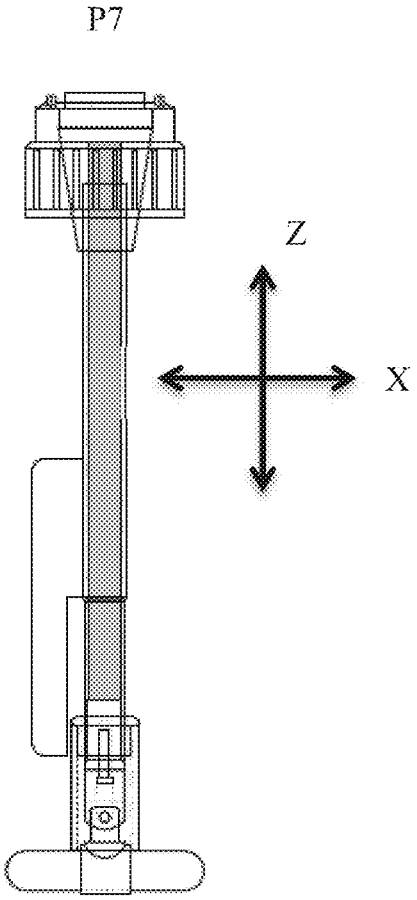

As shown in FIGS. 5-6, the lock sleeve 9 may be lowered along the extension unit until it surrounds the lower hinge portion and/or otherwise abuts against the mixing unit, thus preventing folding of the mixing unit around the pivot (e.g., preventing rotation of the lower hinge portion 7 with respect to the upper hinge 6 in the XZ plane). The lock sleeve may be held upward by a friction fit around the extension shaft 10, and may be held down by such a friction fit as well. Alternatively, the lock sleeve may fall into place by gravity, and should be heavy enough to avoid moving upward when in the fluid to avoid buoyancy. The inner diameter of the lock sleeve may slidably engage or surround (be set just too slightly abut or just slightly greater than the outer dimensions of a corresponding portion of) the lower hinge portion so that the stir bar will not wobble or will not inadvertently rotate upward.

Detailed Description of Exemplary Components in FIGS. 8A-19

FIGS. 8A, 8B & 8C

Figure 8A:
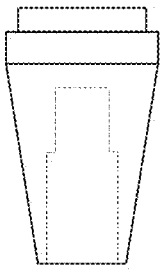
Figure 8B:
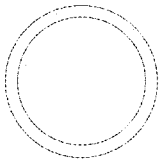
Figure 8C:
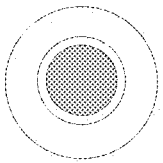

FIGS. 8A (Side view; Z axis up and X axis horizontal), 8B (top view, Y axis up and X axis horizontal) and 8C (bottom view, Y axis up and X axis horizontal) show an exemplary illustration of cap connector 1. The cap connector 1 may connect the cap unit to the extension unit, and may include an upper section (FIG. 8A, top rectangle), a mid-section (FIG. 8A, rectangle immediately below upper section), and a lower section (FIG. 8A, portion below mid-section).

The upper section may have a smaller diameter than the mid-section, which may assist with engagement of the cap connector 1 with the cap 12. The upper section may be sized to be press fit into a corresponding opening of the cap 12.

The lower section may have a diameter that tapers along the Z-axis away from the mid-section to a lower edge. The lower section may be formed with a downward opening cavity sized to receive the extension shaft 10 of the extension unit.

FIGS. 9A & 9B

Figure 9A:
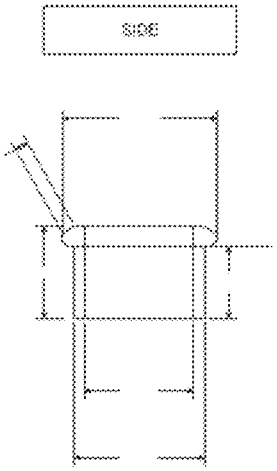
Figure 9B:
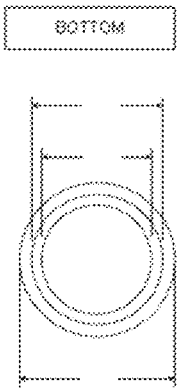

FIGS. 9A (side view, Z axis up and X axis horizontal) and 9B (Y axis up and X axis horizontal) show an exemplary illustration of the lock sleeve cap 2. The lock sleeve cap 2 may be formed with an upper opening (smallest circle in FIG. 9A) and a lower opening (smallest circle in FIG. 9B) that are sized to permit the lock sleeve cap 2 to be sleeved over the extension shaft 10.

Alternatively, the lock sleeve and lock sleeve cap make be formed unitarily, e.g., by machining the lock sleeve and cap out of one piece of bar stock.

FIGS. 10A & 10B

FIGS. 10A (Side view; Z axis up and X axis horizontal) and 10B (Y axis up and X axis horizontal) show an exemplary illustration of an upper bearing 3 that includes an upper section (large rectangular portion) and a lower section (remainder below the rectangular portion beginning at beveled edges). The upper section may have an outer diameter sized to be press fit into an opening of the extension shaft 10. In other embodiments, the upper section may be bonded with or attached to the extension shaft, such as by using adhesive, screws, or other bonding mechanisms. The upper bearing may be integrally formed with the extension shaft 10.

The lower section may have a bottom face formed with an opening sized to receive the bearing pin 4. The opening may be part of a shaft that is formed within the upper bearing 3 and that extends along the Z-axis. The bearing pin 4 may be inserted into the shaft in the upper bearing 3 and secured such that the bearing pin 4 can support the weight of the mixing unit, including the upper hinge portion 6, the lower hinge portion 7, and the first and second elongate members. The bearing pin 4 may hold the upper hinge portion 6 against the upper bearing 3.

FIG. 11

Figure 11:
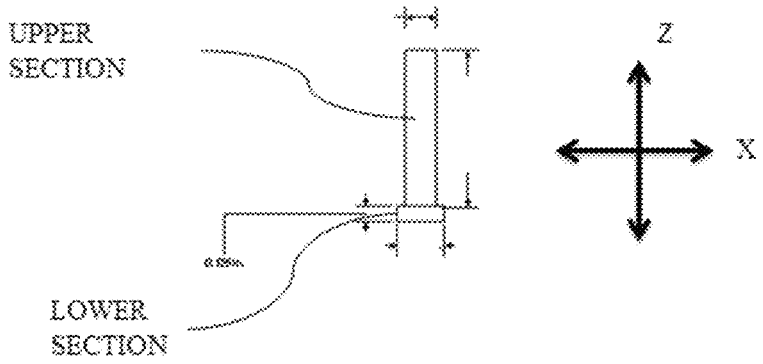

FIG. 11 (side view, Z axis up and X axis horizontal) is an exemplary illustration of a bearing pin 4 having an upper section and a lower section. The upper section may be sized to be passed through an opening of the upper hinge portion 6, and to be press fit into the shaft of the upper bearing. The lower section may have a diameter that is larger than the diameter of the upper section, which may permit the upper surface of the lower section of the bearing pin 4 to contact a lower interior surface of an upper wall of the upper hinge portion 6, and to hold the upper hinge portion 6 against the upper bearing 3.

FIG. 12

Figure 12:
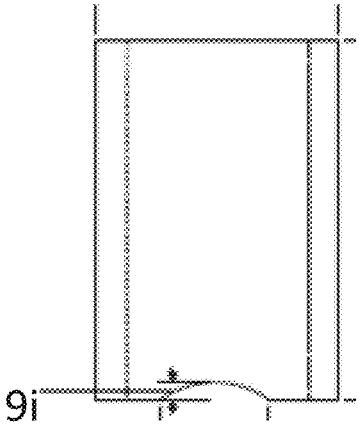

FIG. 12 (side view, Z axis up and Y axis horizontal) is an exemplary illustration of the lock sleeve 9, which is preferably generally cylindrical may have an interior diameter sufficiently large to be sleeved over the extension shaft 10 and to receive the lock sleeve cap 2. The bottom edge of the lock sleeve 9 may be formed with a pair of indentations 9*i* that correspond in location to the intersection of the X-axis with a central longitudinal axis of the lock sleeve 9 that extends along the Z-axis. The indentations 9*i* may be formed to receive and conform to an upper surface of the first and second elongate members when the lock sleeve is abutted against the first and second elongate members. The lock sleeve 9 may oppose rotation of the lower hinge portion around the Y-axis relative to the upper hinge portion 7 and the extension unit. In other words, the lock sleeve 9 may restrict folding of the mixing unit around the pivot between the upper hinge portion 6 and the lower hinge portion 7 when lowered into place and abutted against the stir bar 12.

FIGS. 13A & 13B

FIGS. 13A (side view, Z axis up and Y axis horizontal) and 13B (Y axis up and X axis horizontal) illustrate an embodiment of upper hinge portion 6. The upper hinge portion 6 includes an upper wall formed with an upper passage (top portion of FIG. 13A) that extends along the Z-axis and that is sized to permit passage of the upper part, but not the lower part, of the bearing pin 4. The upper hinge portion 6 is further formed with a lower passage (where the upper passage ends and forming a shoulder) which passage extends along the Z-axis that is in fluid communication with the upper passage, and that is sized to permit insertion of the lower part of the bearing pin 4.

The upper hinge portion 6 is further formed with a first projection (its left side proximate the bottom) and a second projection (its right side proximate the bottom) that together define a slot extending in the YZ-plane for receiving the lower hinge portion 7. Each of the first projection and the second projection are formed with a corresponding pivot receiving passage that extends along the X-axis (the circle in FIG. 13B). Each of the first and second projection may have a lower edge that corresponds to an arc formed in the YZ-plane that is projected along the X-axis.

FIGS. 14A & 14B

Figure 14A:
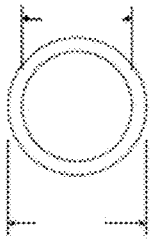
Figure 14B:
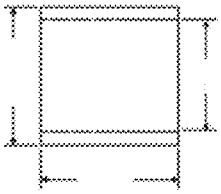

FIGS. 14A (side view, Z axis up and Y axis horizontal) and 14B (Z axis up and X axis horizontal) illustrate a lower part of the lower hinge portion 7. The lower part may be a cylinder that extends along the X-axis, and that has an inner diameter sized to correspond to the first and second elongate members (e.g., the stir bar 12). In some embodiments, the lower part may be bonded, attached to, or integrally formed with the upper part of the lower hinge portion 7 and/or the first and second elongate members.

FIGS. 15A, 15B & 15C

Figure 15A:
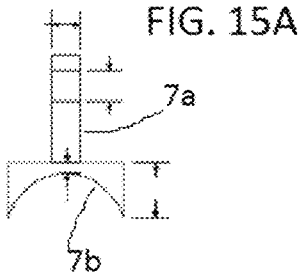
Figure 15B:
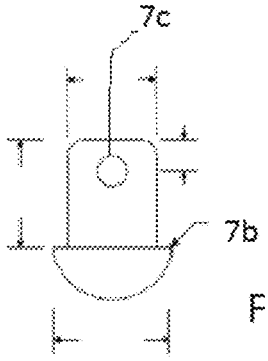
Figure 15C:
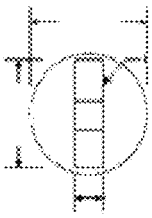

FIGS. 15A (side view, Z axis up and X axis horizontal), 15B (side view, Z axis up and Y axis horizontal) and 15C (top view, Y axis up and X axis horizontal) illustrate an upper part of the lower hinge portion 7, which may have a first section 7*a* and a second section 7*b*. The first section 7*a* may include a wall that extends upward along the Z-axis and is parallel to the YZ-plane. The first section may be formed with a passage 7*c* that extends along the X-axis and is sized to receive the pivot, which may attach the lower hinge portion 7 to the upper hinge portion 6.

The second section may be attached to or integrally formed with the first section, and may be formed to receive and conform to the external cylindrical surface of the lower part of the lower hinge portion 7, which may be a cylinder that extends along the Y-axis. The lower boundary of the second section along the Z-axis, when projected along the X-axis into the YZ-plane, may have a rounded shape that corresponds to an arc in the YZ-plane that opens upward along the Z-axis. The projection of the outer boundary of the second section along the Z-axis into the YX-plane may be circular.

FIGS. 16A & 16B

Figure 16A:
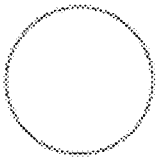
Figure 16B:
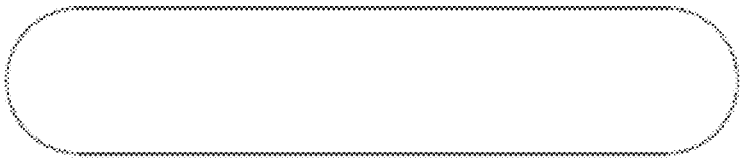

FIGS. 16A (end view, Z axis up and Y axis horizontal) and 16B (side view, Z axis up and X axis horizontal) illustrate an embodiment of the first and second elongate members (e.g., stir bar 12), which are shown here as an integrally formed elongated bar with a round cross section and rounded ends. As discussed above, the ends may be formed with rectangular or other shaped fins that may create different fluid effects within a container.

FIGS. 17A & 17B

Figures 17A, 17B:
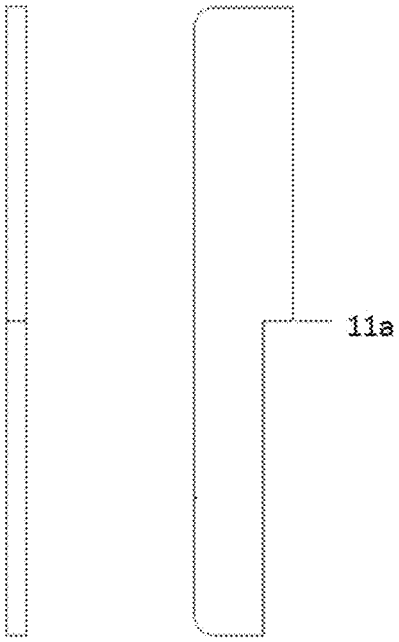

FIGS. 17A (end view, Z axis up and Y axis horizontal) and 17B (side view, Z axis up and X axis horizontal) illustrate an embodiment of baffle 11. As discussed above, the baffle 11 may have a first section (the upper part) and a second section (the lower part) divided at recess 11*a*.

Figure 18:
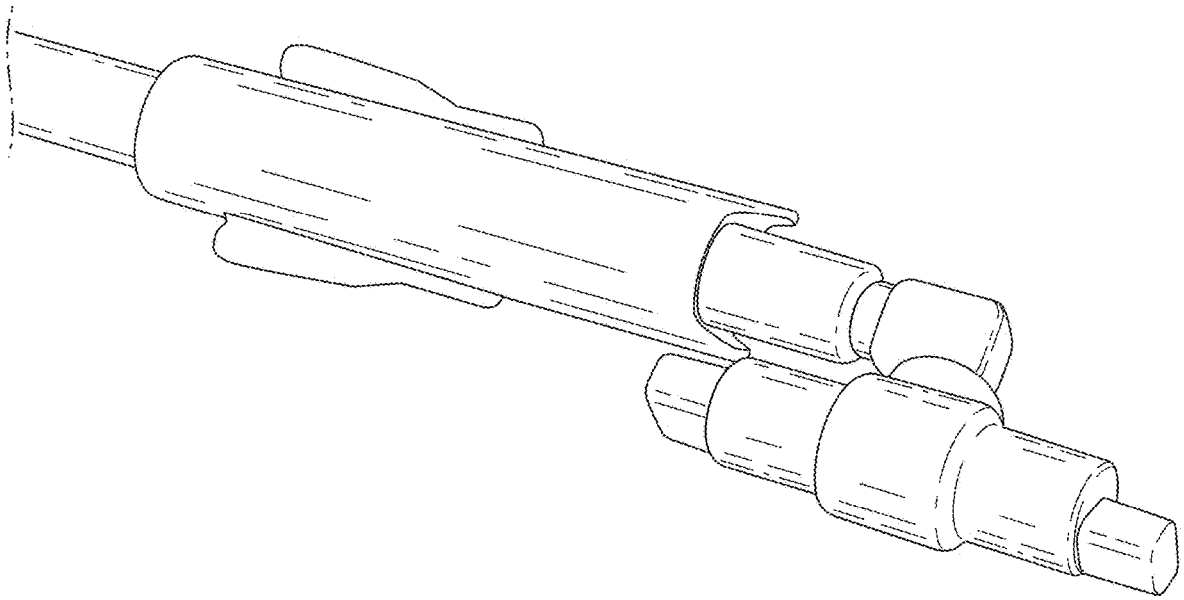
FIG. 18 is a partial perspective view of the mixing system, according to an embodiment.
Figure 19:
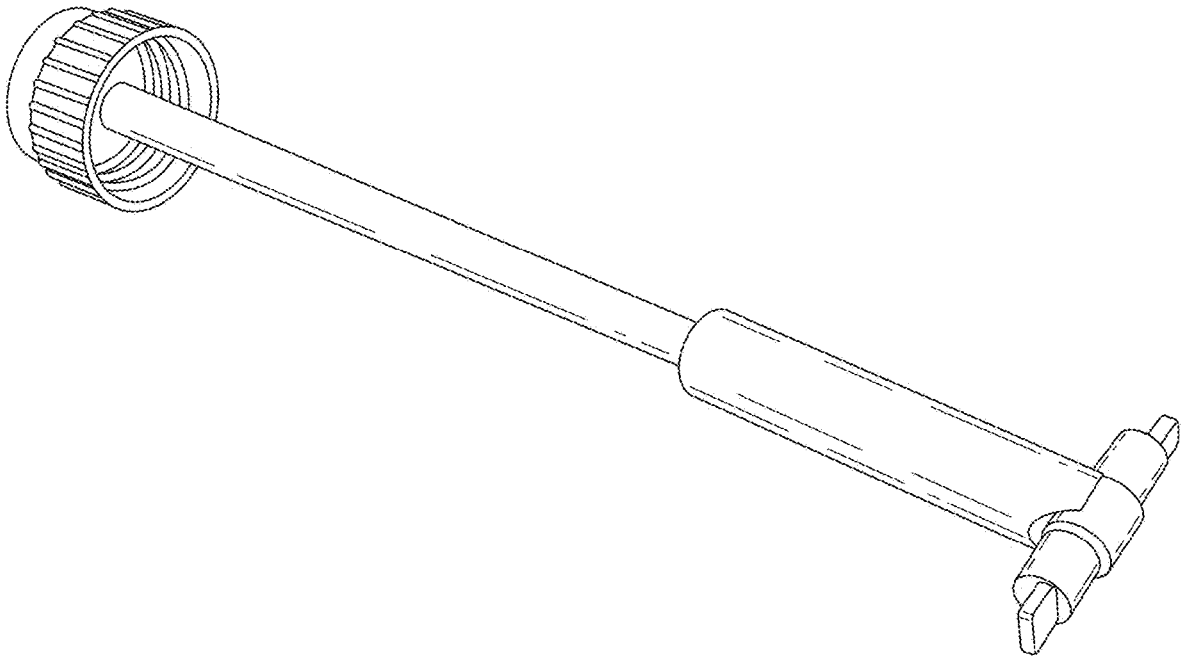
FIG. 19 is a perspective view of the mixing system, according to an embodiment.

FIGS. 18 and 19

FIG. 18 is a partial enlarged perspective view of an embodiment of the system. In FIG. 18, the ends of the first and second elongate members may be seen to have fins that extend in the same direction as the first and second elongate members. The lower hinge portion has been pivoted relative to the upper hinge portion, and the first and second elongate members extend along an axis substantially parallel to an extension shaft axis. The lock sleeve has been raised, and includes a pair of oppositely disposed baffles that extend from the sides of the lock sleeve. The baffles taper towards the ends of the baffles that are closest to the upper hinge.

FIG. 19 is an image of the assembled system, with the lock sleeve lowered into abutting contact with the lower part of the lower hinge portion, thereby locking or holding the lower hinge portion and thus the mixing unit in its deployment position.

Exemplary Illustrations of the System with Containers

Figure 20:
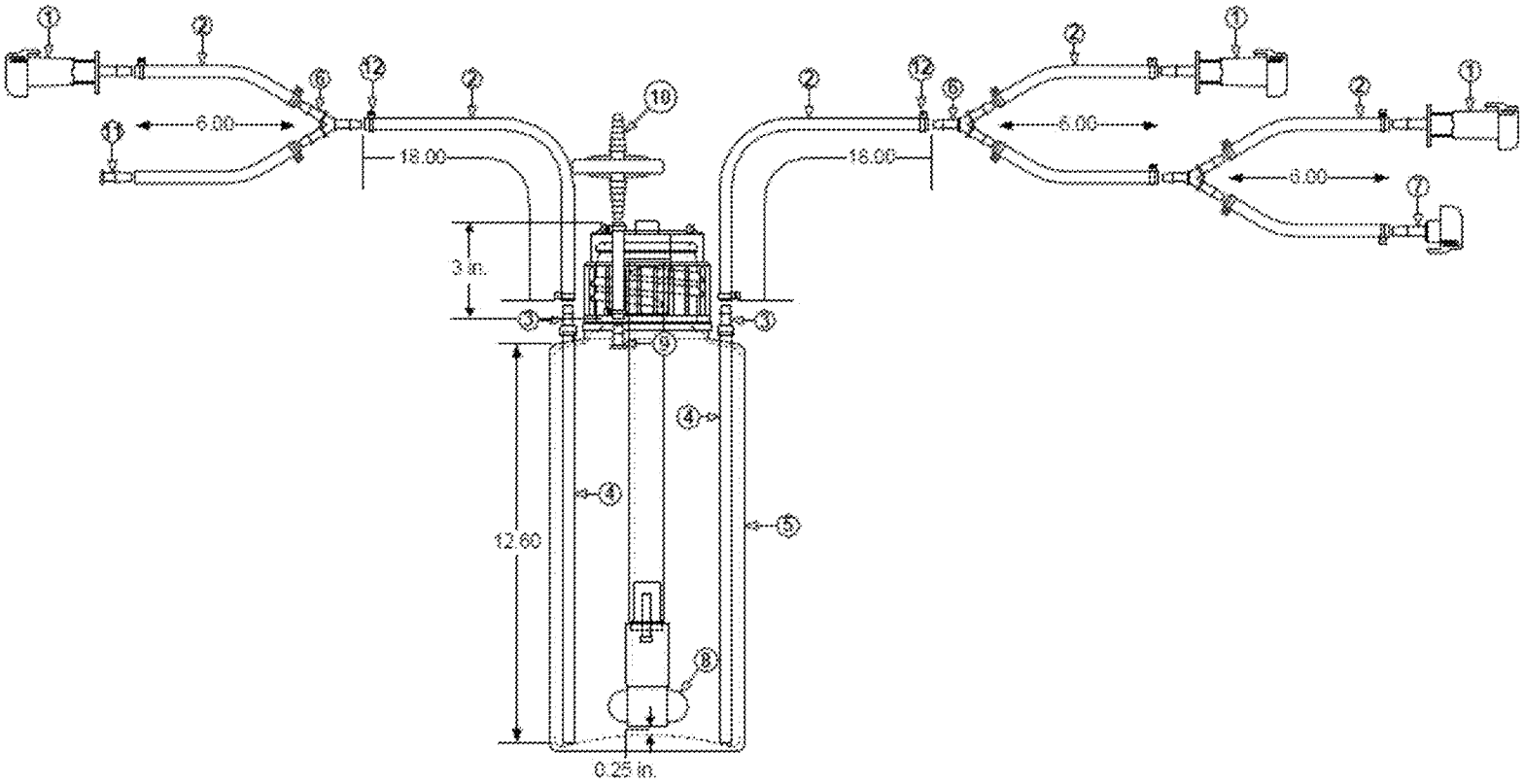
FIG. 20 illustrates a mixing system installed in a container as well as other items, according to an embodiment.
Figure 21:
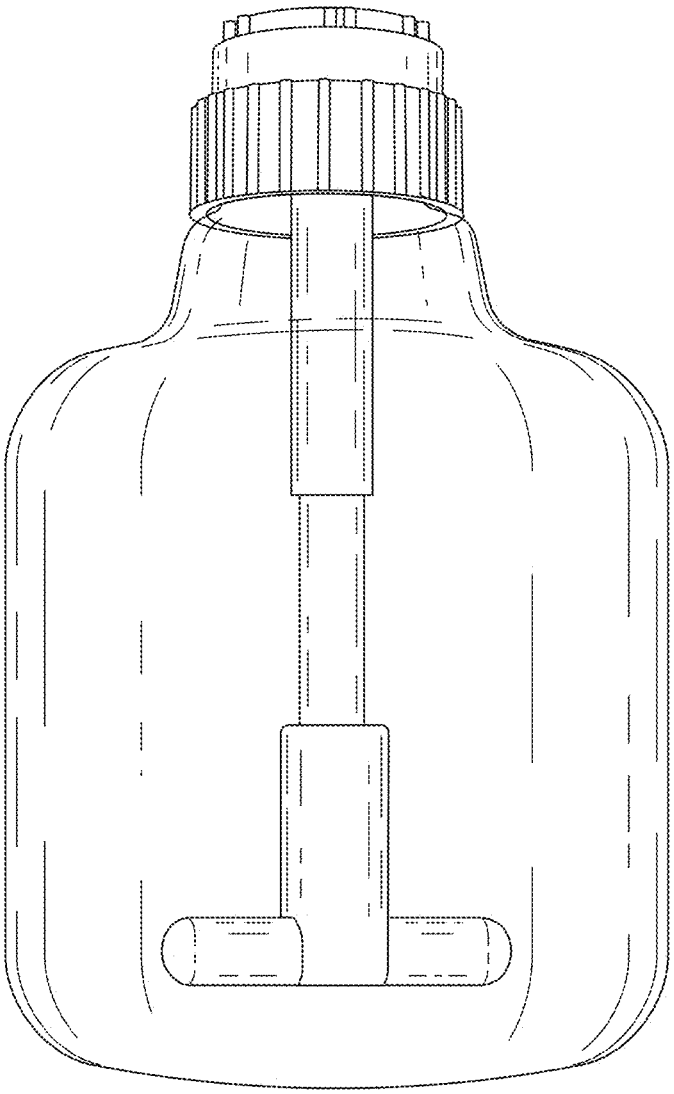
FIG. 21 is view of a container, according to an embodiment.
Figure 22:
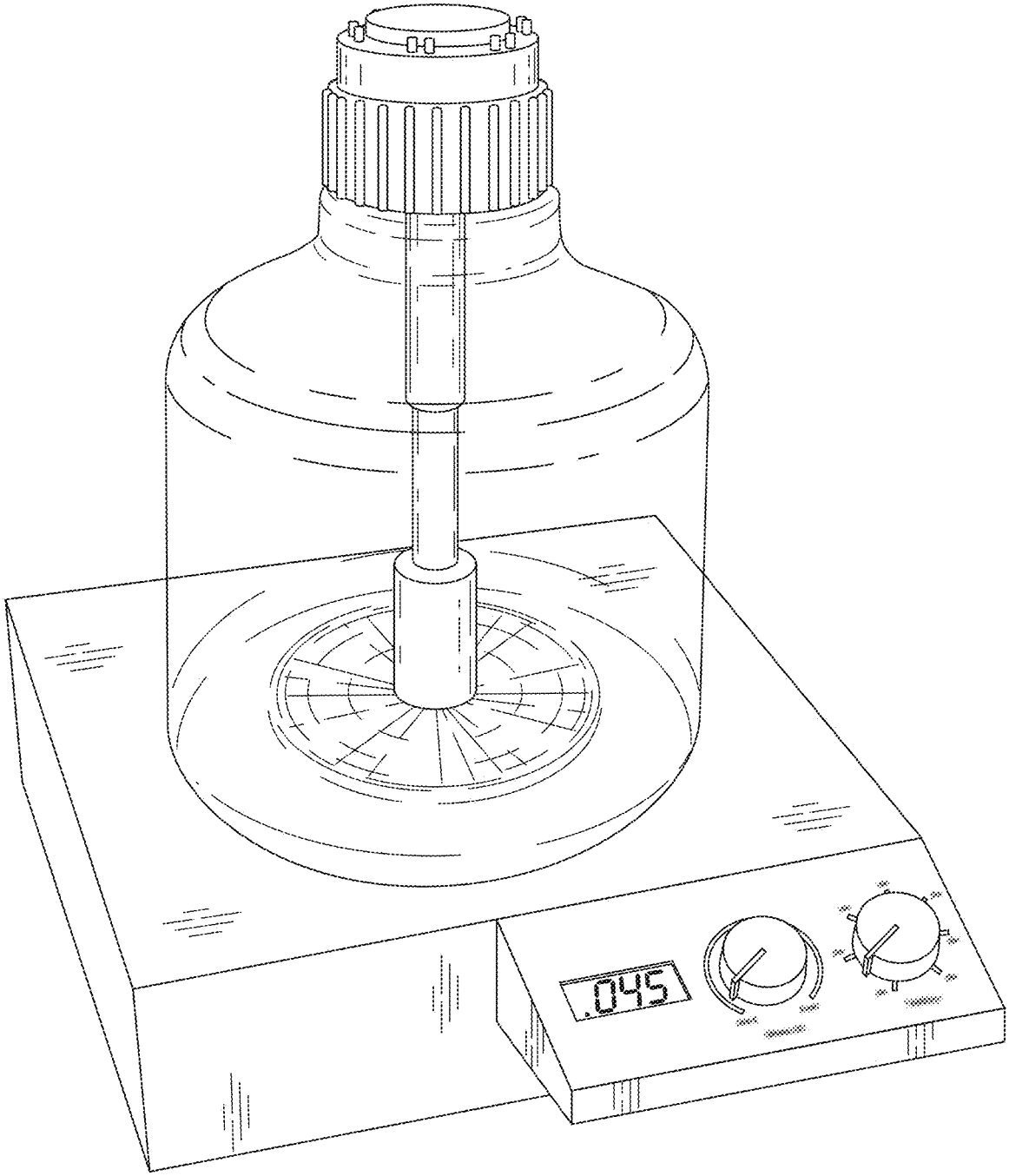
FIG. 22 is a perspective view of a mixing system installed in a container being driven by an external magnet, according to an embodiment.

FIGS. 20, 21, and 22

FIG. 20 is an image of the system installed in a container with inlet and outlet ports, and a variety of piping systems.

FIG. 21 is an image of the system installed in a container.

FIG. 22 is an image of the mixing unit being driven to rotate around the Z-axis by an external magnetic system.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

It is claimed:

1. A method of preparing and using an aseptic mixing system, comprising:

providing an aseptic plastic container which when upright has a narrow upper mouth leading to a wider bottom mixing portion;

providing a mixer comprising:

a cap configured to engage the container upper mouth, the cap and upper mouth being configured to form an aseptic seal and maintain an aseptic environment within the container, an extension shaft having a first end connected to an underside of the cap and extending along a longitudinal axis to a second end, the extension shaft including an aluminum inner reinforcing rod encapsulated in an inert plastic, an upper hinge portion rotatably secured to the second end so that the upper hinge portion may freely rotate about the longitudinal axis, a single mixing bar having a length greater than a width of the upper mouth but less than a width of the wider bottom mixing portion of the container, the mixing bar including a magnetic member encapsulated in an inert plastic and having a specific gravity that will enable the mixing bar to sink in water, and a lower hinge portion secured at a center of the mixing bar so as to divide the mixing bar into first and second elongate members extending in opposite directions, the lower hinge portion being pivotally connected to the upper hinge portion about a lateral pivot axis that is perpendicular to the longitudinal axis, wherein the mixing bar may freely pivot between an insertion position parallel to the longitudinal axis and laterally adjacent to the extension shaft and a deployment position perpendicular to the longitudinal axis and spaced from the second end of the extension shaft, and a tubular lock sleeve axially slidable along the extension shaft between a locked position surrounding the lower hinge portion which prevents the mixing bar from pivoting out of the deployment position and an unlocked position which permits the mixing bar to pivot between the insertion position and the deployment position, sliding the lock sleeve along the extension shaft to the unlocked position, and pivoting the mixing bar to the insertion position, wherein the lower hinge portion prevents the lock sleeve from sliding back to the locked position when the mixing bar is in the insertion position, inserting the mixer through the upper mouth into the container and positioning the container upright so that the mixing bar freely pivots by gravity to the deployment position once past the upper mouth and permits the lock sleeve to drop by gravity to the locked position, engaging the cap onto the container upper mouth to form an aseptic seal and maintain an aseptic environment within the container, adding a bioreactor fluid to the container, rotating the mixing bar about the longitudinal axis the using an external magnetic drive system located outside the container, and culturing cells in the container while rotating the mixing bar.

2. The method of claim 1, wherein the upper mouth has external threads and the cap has internal threads configured to engage the external threads.

3. The method of claim 1, wherein, in the deployment position, the lock sleeve is held upward by a friction fit around the extension unit, and the step of sliding the lock sleeve to the unlocked position includes sliding the lock sleeve upward until it is held by friction around the extension unit, and the method further includes releasing the friction hold of the lock sleeve onto the extension unit prior to the step of inserting the mixing bar through the upper mouth.

4. The method of claim 1, wherein the magnetic member is a neodymium magnet having a nickel coating.

5. The method of claim 1, wherein the inert plastic around both the extension shaft and the mixing bar comprises a gamma stable thermoplastic selected from the group of PVDF, PP, PE and PC, and the specific gravity of the mixing bar is in a range of 1.6 to 2.0.

6. The method of claim 1, further including one or more baffles attached to and extending radially outward from the extension shaft.

7. The method of claim 6, wherein the one or more baffles comprises a single longitudinally-oriented baffle extending laterally away from the extension shaft with a first section and a second section closer to the second end of the extension shaft that is thinner laterally than the first section and spaced from the extension shaft to form a recess configured to receive the lock sleeve when the lock sleeve slides to the unlocked position.

8. The method of claim 1, wherein the mixing bar has a round cross section and the first and second elongate members terminate at rounded ends.

9. The method of claim 1, wherein the mixing bar includes angled plates or fins that extend outward from ends of the first and second elongate members.

10. A method of preparing and using an aseptic mixing system, comprising:

providing an aseptic container which when upright has a narrow upper mouth leading to a wider bottom mixing portion;

providing a mixer comprising:

a cap configured to engage the container upper mouth, the cap and upper mouth being configured to form an aseptic seal and maintain an aseptic environment within the container, an extension shaft having a first end connected to an underside of the cap and extending along a longitudinal axis to a second end, an upper hinge portion rotatably secured to the second end so that the upper hinge portion may freely rotate about the longitudinal axis, a single mixing bar having a length greater than a width of the upper mouth but less than a width of the wider bottom mixing portion of the container, the mixing bar containing a magnet and having a round cross section and terminating at rounded ends, and a lower hinge portion secured at a center of the mixing bar so as to divide the mixing bar into first and second elongate members extending in opposite directions, the lower hinge portion being pivotally connected to the upper hinge portion about a lateral pivot axis that is perpendicular to the longitudinal axis, wherein the mixing bar may freely pivot between an insertion position parallel to the longitudinal axis and laterally adjacent to the extension shaft and a deployment position perpendicular to the longitudinal axis and spaced from the second end of the extension shaft, and a lock sleeve axially slidable along the extension shaft between a locked position which prevents the mixing bar from pivoting out of the deployment position and an unlocked position which permits the mixing bar to pivot between the insertion position and the deployment position, sliding the lock sleeve along the extension shaft to the unlocked position, and pivoting the mixing bar to the insertion position, inserting the mixer through the upper mouth into the container and positioning the container upright so that the mixing bar freely pivots by gravity to the deployment position once past the upper mouth and the lock sleeve drops by gravity to the locked position, engaging the cap onto the container upper mouth to form an aseptic seal and maintain an aseptic environment within the container, adding a bioreactor fluid to the container, rotating the mixing bar about the longitudinal axis the using an external magnetic drive system located outside the container, and culturing cells in the container while rotating the mixing bar.

11. The method of claim 10, wherein the upper mouth has external threads and the cap has internal threads configured to engage the external threads.

12. The method of claim 10, wherein the lock sleeve is tubular and surrounds the lower hinge portion in the locked position which prevents pivoting of the lower hinge portion and thus the mixing bar from pivoting out of the deployment position.

13. The method of claim 12, wherein, in the deployment position, the lock sleeve is held upward by a friction fit around the extension unit, and the step of sliding the lock sleeve to the unlocked position includes sliding the lock sleeve upward until it is held by friction around the extension unit, and the method further includes releasing the friction hold of the lock sleeve onto the extension unit prior to the step of inserting the mixing bar through the upper mouth.

14. The method of claim 10, wherein the magnet is a neodymium magnet having a nickel coating.

15. The method of claim 10, wherein the extension shaft is covered by an inert plastic and the mixing bar is an elongated magnetic bar covered by an inert plastic.

16. The method of claim 15, wherein the inert plastic comprises a gamma stable thermoplastic selected from the group of PVDF, PP, PE and PC, and the specific gravity of the mixing bar is in a range of 1.6 to 2.0.

17. The method of claim 10, further including one or more baffles attached to and extending radially outward from the extension shaft.

18. The method of claim 17, wherein the one or more baffles comprises a single longitudinally-oriented baffle extending laterally away from the extension shaft with a first section and a second section closer to the second end of the extension shaft that is thinner laterally than the first section and spaced from the extension shaft to form a recess configured to receive the lock sleeve when the lock sleeve slides to the unlocked position.

19. The method of claim 10, wherein the step of inserting the mixer through the upper mouth into the container is done with the container at an angle such that the container must be subsequently rotated to an upright position.

20. The method of claim 10, wherein the mixing bar includes angled plates or fins that extend outward from ends of the first and second elongate members.

* * * * *